United States Patent [19]

Oda et al.

[11] Patent Number: 4,625,212

[45] Date of Patent: Nov. 25, 1986

[54] DOUBLE LOOP ANTENNA FOR USE IN CONNECTION TO A MINIATURE RADIO RECEIVER

[75] Inventors: Takashi Oda; Koji Yamasaki, both of Tokyo, Japan

[73] Assignee: NEC Corporation, Tokyo, Japan

[21] Appl. No.: 590,617

[22] Filed: Mar. 19, 1984

[30] Foreign Application Priority Data

Mar. 19, 1983 [JP] Japan ..... 58-45315
Mar. 19, 1983 [JP] Japan ..... 58-45316

[51] Int. Cl.[4] ..... H01Q 1/24

[52] U.S. Cl. ..... 343/702; 343/744; 455/351; 455/270

[58] Field of Search ..... 343/702, 741, 742, 743, 343/744, 718, 746, 748, 855, 867; 455/193, 351, 269, 270, 272–274

[56] References Cited

U.S. PATENT DOCUMENTS 3,210,766 10/1965 Parker ..... 343/748
3,508,271 4/1970 Kuecken ..... 343/830
3,573,832 4/1971 Callaghan ..... 343/742
3,623,161 11/1971 Fujimoto ..... 343/702
3,736,591 5/1973 Rennels et al. ..... 343/702
4,123,756 10/1978 Nagata et al. ..... 343/702

*Primary Examiner*—Eli Lieberman
*Assistant Examiner*—Michael C. Wimer
*Attorney, Agent, or Firm*—Sughrue, Mion,Zinn, Macpeak, and Seas

[57] ABSTRACT

An antenna having an antenna aperture area and an antenna reactance comprises a first antenna element (31) defining a first aperture area and a first reactance and a second antenna element (32) connected in parallel to the first antenna element to put a miniature radio receiver into operation in a desired frequency band. The second antenna element has a second aperture area and a second reactance greater than the first aperture area and reactance, respectively, so that the antenna aperture area and reactance are substantially determined by the second aperture area and the first reactance, respectively. The first and the second aperture areas may be coplanar. Alternatively, the aperture areas may be orthogonal to each other.

5 Claims, 11 Drawing Figures

DOUBLE LOOP ANTENNA FOR USE IN CONNECTION TO A MINIATURE RADIO RECEIVER

BACKGROUND OF THE INVENTION

This invention relates to an antenna for use in a miniature radio receiver which may be, for example, a portable radio receiver, such as a pager receiver.

Recent requirements are such that an antenna of the type described is for use in a high frequency range, such as a frequency range between 440 and 460 megahertz, with a high antenna gain. Inasmuch as the antenna gain increases with an aperture area, as called in the art, the apreture area should be wide in order to increase the antenna gain.

A conventional antenna is usually housed in a hollow space enveloped by a housing or casing of a miniature radio receiver and is coupled to a reactance circuit to be put into operation as a loop antenna. The antenna should be reduced in size because the antenna must have a low reactance so as to be used in the above-exemplified high frequency range. Such a reduction of the antenna size inevitably results in a reduction of the aperture area and, therefore, lowers the antenna gain. The reduced antenna leaves a superfluous space in the hollow space when the housing is not changed in size. Thus, the hollow space is not effectively utilized in the receiver in which the reduced antenna is accommodated in the hollow space.

In. U.S. Pat. No. 3,736,591, issued to L. W. Rennels et al on May 29, 1973, and assigned to Motorola, Inc., an antenna is disclosed which has a U-shaped configuration and serves as a part of a housing a miniature radio receiver. The proposed antenna is effectively used in a low frequency range between 148 and 174 megahertz in cooperation with a reactance circuit connected thereto. A comparatively high antenna gain may be attained in the low frequency range in comparison with the abovementioned antenna housed in the housing. In order to be used in the high frequency region as mentioned above, the proposed antenna should be reduced in size like in the abovementioned antenna. In addition, the housing should also be reduced in size because the antenna serves as the part of the housing. As a result, the antenna gain is inevitably lowered when used in the high frequency range.

SUMMARY OF THE INVENTION

It is an object of this invention to provide an antenna which is for use in a miniature radio receiver and which is capable of accomplishing a high antenna gain in a high frequency range.

It is another object of this invention to provide an antenna of the type described, which is capable of effectively utilizing a hollow space enveloped by a housing of a miniature radio receiver.

An antenna to which this invention is applicable is for use in connection to a miniature radio receiver and comprises a first antenna element having a first predetermined aperture area, a first pair of end portions, and a first predetermined reactance. The end portions are for connection across a reactance circuit of the miniature radio receiver. According to this invention, the antenna comprises a second antenna element having a second predetermined aperture area, a second pair of end portions, and a second predetermined reactance. The second predetermined aperture area and reactance are greater than the first predetermined aperture area and reactance, respectively. The second antenna element is connected in parallel to the first antenna element so that the second pair of end portions is superposed on the first pair of end portions and that the antenna has an antenna aperture area specified by the second predetermined aperture area and an antenna reactance given by a combination of the first and the second predetermined reactances.

DESCRIPTION OF THE PREFERRED EMBODIMENTS

Figure 1:
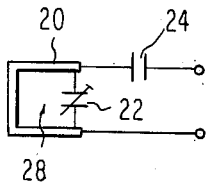
FIG. 1 PRIOR ART
FIG. 1 shows a schematic elevation of a conventional antenna together with an electric circuit connected to the antenna.

Referring to FIG. 1, a conventional antenna will be described for a better understanding to this invention. This antenna is housed in a housing (not shown) of a miniature radio receiver. Let the antenna be used in a desired frequency band including, for example, 450 MHz. The illustrated antenna is specified by an antenna element 20 having a pair of end portions and a predetermined reactance. The predetermined reactance may be considered an inductance in the desired frequency band. An antenna circuit if formed by connecting a variable capacitor 22 between the end portions and by connecting an additional capacitor 24 to one of the end portions. The antenna circuit has a loop formed by the antenna element 20 and the variable capacitor 22. A combination of the variable and the additional capacitors 22 and 24 may be called a reactance circuit. It is possible to provide a predetermined output impedance at the desired frequency band by selecting the predetermiend reactance and both capacitances of the variable and the additional capacitors 22 and 24. In other words, the antenna circuit is tuned to or resonant with the desired frequency band in cooperation with the inductance and both of the capacitances. As the desired frequency band becomes high, each of the inductance and the capacitances should become small. Inasmuch as each capacitance has an irreducible limitation, the inductance should be rendered small with an increase of the desired frequency band.

An aperture area is determined by the loop formed by the antenna element 20 connected to the variable capacitor 22 and should be reduced with a decrease of the inductance. An antenna gain is therefore lowered with a reduction of the aperture area, as described in the preamble of the instant specification.

Figure 2:
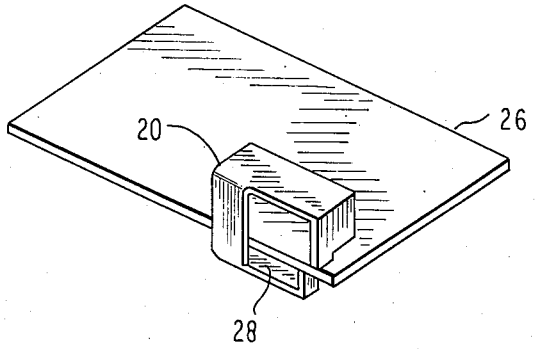
FIG. 2 PRIOR ART
FIG. 2 shows a perspective view of the conventional antenna illustrated in FIG. 1 together with a printed board on which the conventional antenna is assembled.

Referring to FIG. 2, the conventional antenna illustrated in FIG. 1 is assembled on a printed board 26 on which the variable capacitor 22 and the additional capacitor 24 (both being not shown in FIG. 2) are deposited in a known manner together with the other elements necessary for the miniature radio receiver. In the example being illustrated, the printed board 26 is of a rectangular shape surrounded by a pair of longitudinal sides and a pair of transverse sides. The printed board 26 has a front surface directed towards the top of FIG. 2 and a back surface opposite to the front surface and directed towards the bottom. The illustrated antenna element 20 has the end portions which are somewhat displaced from each other and which are attached to the variable capacitor 22 laid on the printed board 26. The aperture area 28 is defined in the antenna element 20 above and below the printed board 26. The antenna element 20 is 13 millimeters high, 5 millimeters wide, and 28 millimeters long. Anyway, the aperture area 28 partially occupies the printed board 26 along one of the longitudinal sides. The antenna gain is about −16 dB at the desired frequency band when represented by a dipole ratio.

It should be mentioned here that the aperture area 28 might be wholly expanded along each longitudinal side of the printed board 26 because a superfluous space is left in the housing of the miniature radio receiver. In other words, it would be possible to accommodate in the superfluous space an antenna greater than the illustrated antenna. However, the aperture area 28 should be determined in dependence upon the desired frequency band. In fact, the aperture area 28 occupies about one-sixth of the superfluous space left in the housing. A reduction of the antenna gain is inevitable with this structure.

Figure 3:
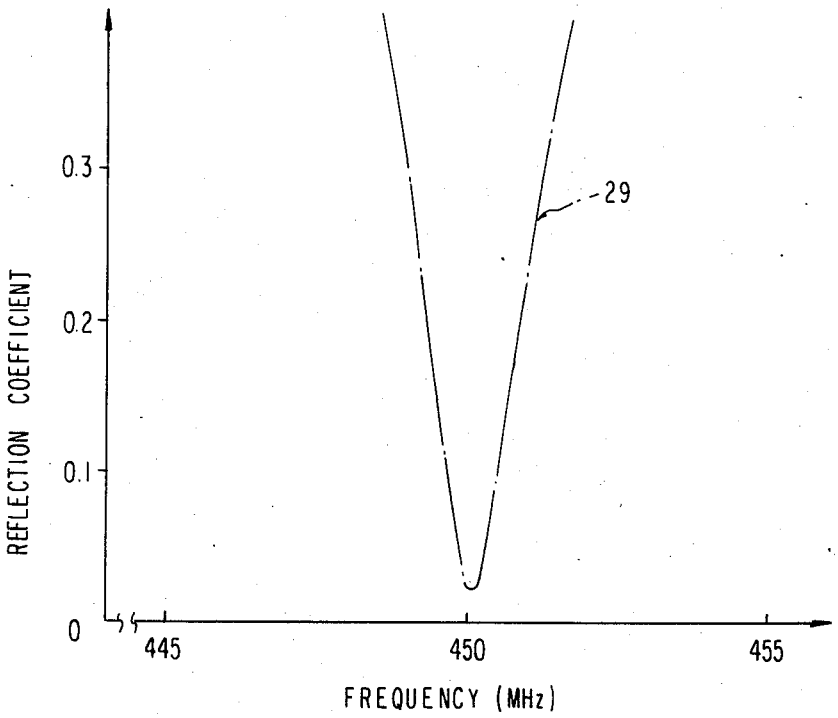
FIG. 3 shows a graphical representation for use in describing a characteristic of the conventional antenna.

Referring to FIG. 3, a curve 29 shows a frequency versus refletion coefficient characteristic of the conventional antenna illustrated in FIG. 2. From the curve 29, it is readily understood that the conventional antenna has a frequency band of 2.7 MHz when the reflection coefficient is equal to 0.33, namely, when a voltage standing-wave ratio (VSWR) is equal to 2.

Figure 4:
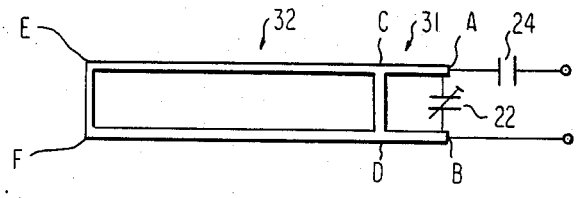
FIG. 4 shows a schematic elevation of an antenna according to a first embodiment of this invention together with an electric circuit connected to the antenna.

Referring to FIG. 4, an antenna according to a first embodiment of this invention comprises a first antenna element 31 of a conductive wire. The first antenna element 31 has a first pair of end portions A and B and a first generally U-shaped conductive path connected across the first pair of end portions A and B through portions C and D, which will be called first and second intermediate portions. Thus, the first conductive path is defined by A-C-D-B. The first antenna element 31 has a first predetermined aperture and a first predetermined reactance which may be similar to the predetermined aperture area and the predetermined reactance described in conjunction with FIGS. 1 and 2, respectively. The first predetermined reactance may therefore be an inductance. Let the inductance be called a first inductance $L_1$ and be equal to 10 nH.

Inasmuch as the variable capacitor 22 and the additional capacitor 24 are connected to the first pair of end portions A and B to form a first antenna circuit in a manner described with reference to FIG. 1, the first antenna element 31 can be tuned to or resonant with the desired frequency band. The first antenna circuit has a first loop formed by the first antenna element 31 and the variable capacitor 22 connected between the first pair of end portions A and B.

A second antenna element 32 of a conductive wire is connected in parallel to the first antenna element 31. More specifically, the second antenna element 32 has a second pair of end portions which are common to the first pair of end portions A and B and which are therefore designated by the same reference letters as the first pair of end portions A and B. The second antenna element 32 has a second conductive path connected across the second pair of end portions through third and fourth intermediate portions E and F placed on extensions of the line segments A-C and B-D, respectively. Thus, the first and second conductive paths are coplanar.

A second predetermined aperture area and a second predetermined reactance are defined by the second conductive path of A-E-F-B and are greater than the first predeterminend aperture area and the first predetermined reactance, respectively. Like the first predetermined reactance, the second predetermined reactance may be an inductance and therefore be called a second inductance $L_2$. The second inductance $L_2$ is selected so as not to be tuned to the desired frequency band in cooperation with the variable capacitor 22 and the additional capacitor 24. In other words, the second inductance $L_2$ is too large to form a resonance circuit in cooperation with the variable capacitor 22 and the additional capacitor 24. Let the second predetermined reactance be equal to 50 nH.

The connection of the variable capacitor 22 and the additional capacitor 24 puts the second antenna element 32 into operation as a second antenna circuit having a second loop formed by the second antenna element 32 and the variable capacitor 22. The antenna illustrated in FIG. 4 may be referred to as a double loop antenna because the antenna has two loops connected to the variable capacitor 22.

From the above, it is readily understood that the second predetermined aperture area is coplanar with the first predetermined aperture area and has a partial area common to the first predetermined aperture area.

The illustrated antenna has an antenna aperture area specified by the second predetermined antenna area and an antenna inductance $L_0$ specified by a combination of the first and the second inductances $L_1$ and $L_2$. Inasmuch as the first and the second antenna elements 31 and 32 are connected in parallel, the antenna inductance $L_0$ is given by:

$$L_0 = L_1 \cdot L_2 / (L_1 + L_2). \quad (1)$$

In Equation (1), the antenna inductance $L_0$ is smaller than the first inductance $L_1$ and is substantially equal to the first inductance $L_1$ when the second inductance $L_2$ is extremely greater than the first inductance $L_1$. Thus, the illustrated antenna is readily tuned to or resonant with the desired frequency band even when the desired frequency band becomes high. Inasmuch as the antenna aperture area is rendered wide, a high antenna gain is accomplished by enlargement of the antenna aperture area.

In addition, a quality factor Q is reduced by connection of the second antenna element 32 to the first antenna element 31. This means that a frequency band of the antenna becomes wide in comparison with the conventional antenna illustrated with reference to FIGS. 1 and 2.

Figure 5:
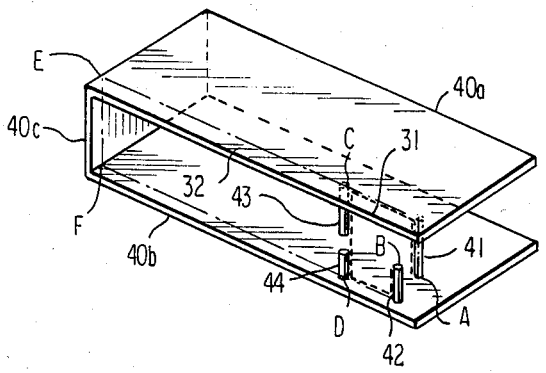
FIG. 5 shows a perspective view of an antenna according to a second embodiment of this invention.

Referring to FIG. 5, an antenna according to a second embodiment of this invention comprises similar parts designated by like reference numerals and letters. The illustrated antenna comprises an upper plate 40*a*, a lower plate 40*b* parallel to the upper plate 40*a* with a gap left therebetween, and a side plate 40*c* contiguous between the upper and the lower plates 40*a* and 40*b*. Each of the upper and the lower plates 40*a* and 40*b* is of a rectangular shape having a pair of long sides and a pair of short sides and is 70 millimeters long and 20 millimeters wide. The side plate 40*c* is 13 millimeters tall. Each plate 40*a* to 40*c* may be equivalent to a great number of wires which are arranged on the upper and the lower plates 40*a* and 40*b* parallel to the long sides and each pair of which is similar to a pair of longitudinal wires used in the antenna of FIG. 4.

The illustrated antenna comprises first and second rods 41 and 42 extended from the upper and the lower plates 40*a* and 40*b* downwards and upwards of FIG. 5, respectively, and third and fourth rods 43 and 44 extended from the upper and the lower plates 40*a* and 40b downwards and upwards of FIG. 5, respectively. The first through the fourth rods 41 and 44 have rod axes perpendicular to a plane defined by a parallel arrangement of wires. Each of the first through the fourth rods 41 to 44 is of an electrical conductor. The first and the second rods 41 and 42 are somewhat dispalced relative to each other in the direction of the long sides. A spacing between the first and the second rods 41 and 42 may be 3 millimeters. The first and the second rods 41 and 42 are not connected to the lower and the upper plates 40*b* and 40*a* to define the first pair of end portions A and B on their ends, respectively.

The third and the fourth rods 43 and 44 have coaxial rod axes to define the first and the second intermediate portions C and D at which the third and the fourth rods 43 and 44 are attached to the upper and the lower plates 40*a* and 40*b*, respectively. The third and the fourth rods 43 and 44 are not connected to each other. The first through the fourth rods 41 to 44 serve to form the first antenna circuit having the first loop, like in FIG. 4. In other words, the first through the fourth rods 41 to 44 serve to define a part of the first antenna element as mentioned in conjunction with FIG. 4. The first antenna element 31 has the first predetermined aperture area specified by the dotted line A-C-D-B.

The third and the fourth intermediate portions E and F which are on the same plane as the first and the second rods 41 and 42 are defined between the upper and the side plates 40*a* and 40c and between the lower and the side plates 40*b* and 40*c*, respectively. Thus, the second antenna element is specified by the first and the second rods 41 and 42 and the third and the fourth intermediate portions E and F. The second antenna element has the second pair of end portions common to the first pair of end portions A and B and the second predetermined aperture area which is defined by an area A-E-F-B and which is on the same plane as the first predetermined aperture area. Thus, the second predetermined aperture area is partially superposed on the first predetermined aperture area. At any rate, the second antenna element serves to form the second antenna circuit having the second loop, like in FIG. 4.

Figure 6:
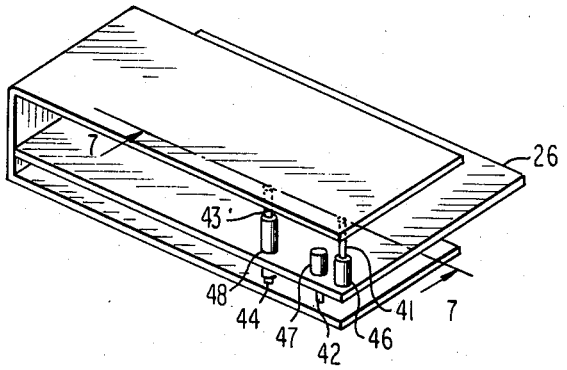
FIG. 6 shows a perspective view of the antenna illustrated in FIG. 5 together with a printed board to which the antenna is attached.
Figure 7:
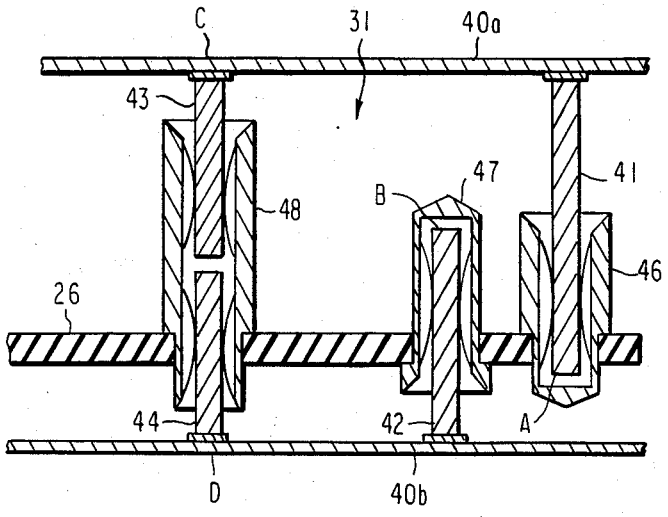
FIG. 7 shows an enlarged sectional view taken by a plane which includes a line 7—7 drawn in FIG. 6.

Referring to FIGS. 6 and 7, the antenna illustrated in FIG. 5 is assembled on a printed board 26 which is similar to that illustrated in FIG. 2 except that through holes are formed on the printed board 26 to receive the rods 41 to 44, as best shown in FIG. 7. The variable capacitor 22 and the additional capacitor 24 are deposited on the printed board 26, as mentioned in conjunction with FIG. 2.

The first and the second rods 41 and 42 are attached to the printed board 26 through first and second receptacles 46 and 47 fixed to the through holes and are electrically connected across the variable capacitor 22. The first rod 41 is also connected to the additional capacitor 24, as shown in FIG. 4.

In FIG. 7, the third and the fourth rods 43 and 44 are electrically connected to each other through a third receptable 48 which is fixed to the through hole to receive both of the third and the fourth rods 43 and 44.

Thus, the first antenna element 31 forms the first antenna circuit by connecting the third rod 43 to the fourth rod 44 through the third conductive receptacle 48 and by connecting the variable capacitor 22 and the additional capacitor 24.

As shown in FIG. 7, the printed board 26 is covered with the upper and the lower plates 40*a* and 40*b* along one of the longitudinal sides of the printed board 26. This means that the second antenna element 32 has the second predetermined aperture area which can cover one of the longitudinal sides of the printed board 26. As a result, it is possible to make the second predetermined aperture area have a maximum space. Thus, the second predetermined aperture area is wider than the first predetermined aperture area and specifies an antenna aperture area of the antenna illustrated in FIGS. 5 through 7. Therefore, the antenna has an antenna gain greater than that of the conventional antenna illustrated in FIG. 2. The antenna gain of the antenna shown in FIGS. 5 through 7 is equal to −12 dB and is improved by 4 dB in comparison with the conventional antenna.

Figure 8:
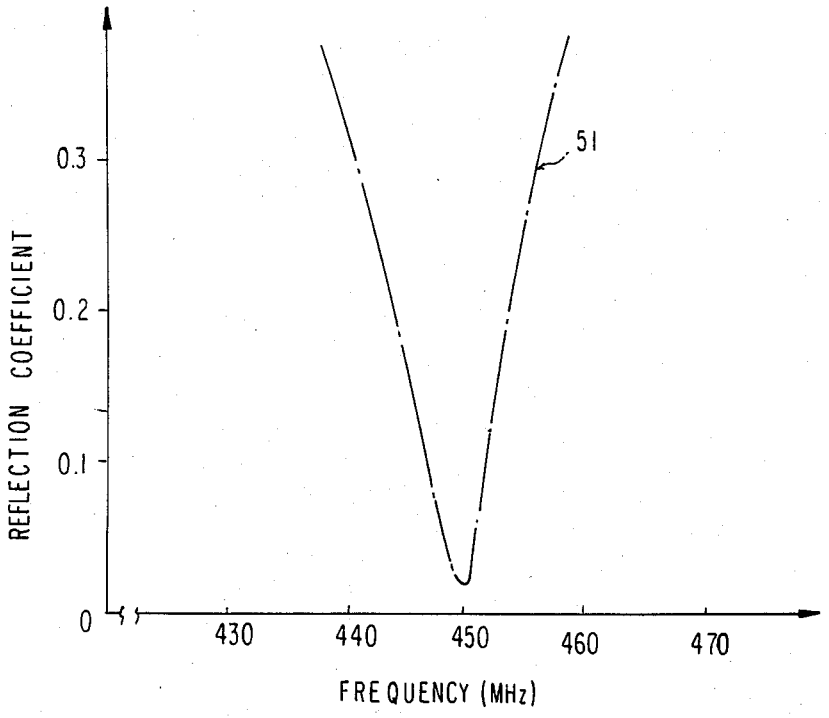
FIG. 8 shows a graphical representation for use in describing a characteristic of the antenna illustrated in FIG. 6.

Referring to FIG. 8, a curve 51 shows a frequency versus reflection coefficient characteristic of the antenna illustrated with reference to FIGS. 5 to 7. It is to be noted in FIG. 8 that the abscissa is gauged on a scale different from that of FIG. 3. As shown in FIG. 8, the antenna has a frequency band of 17.5 MHz when the reflection coefficient is equal to 0.33. From this fact, it is understood that the frequency band of the antenna illustrated in FIGS. 5 to 7 is expanded to about 6.5 times that frequency band of the conventional antenna which is illustrated in FIG. 3.

Figure 9:
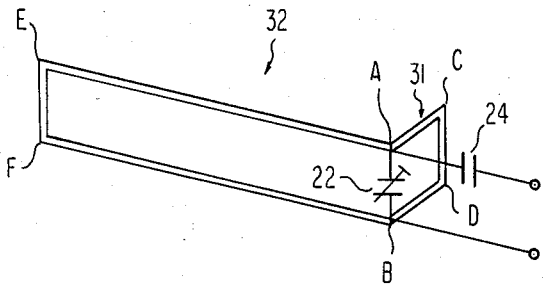
FIG. 9 shows a perspective view of an antenna according to a third embodiment of this invention.

Referring to FIG. 9, an antenna according to a third embodiment of this invention is similar to that illustrated in FIG. 4 except that the first antenna element 31 is substantially orthogonal to the second antenna element 32. More particularly, the first and the second antenna elements 31 and 32 are formed by a single conductive wire. Like in FIG. 4, the first antenna element 31 has a first pair of end portions A and B and a first predetermined aperture area defined by the first pair of end portions A and B and the first and the second intermediate portions C and D. The first antenna element 31 has a first inductance $L_1$ similar to that illustrated in FIG. 4.

The second antenna element 32 has a second pair of end portions connected in common to the first pair of end portions A and B and a second predetermined aperture area defined by the second pair of end portions and the third and the fourth end portions E and F. The second predetermined aperture area is greater than the first predetermined aperture area, as is the case with FIG. 4. As shown in FIG. 9, the second predetermind aperture area is substantially orthogonal to the first predetermined aperture area. The second antenna element 32 has a second inductance $L_2$ similar to that illustrated in FIG. 4.

The variable capacitor 22 and the additional capacitor 24 are connected in the manner described in conjunction with FIG. 4 to be tuned to the desired frequency.

The illustrated antenna has a wide antenna aperture area and a reduced inductance, like in FIG. 4. Therefore, it is possible to accomplish a high antenna gain.

Figure 10:
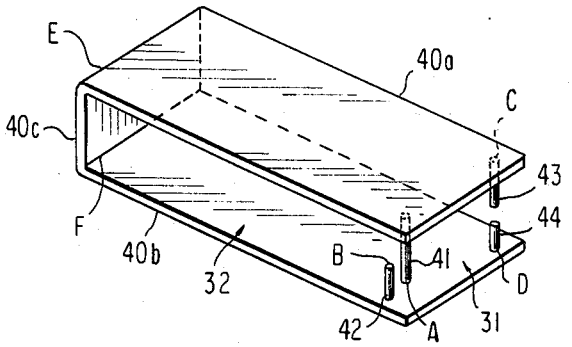
FIG. 10 shows a perspective view of an antenna according to a fourth embodiment of this invention.

Referring to FIG. 10, an antenna according to a fourth embodiment of this invention in similar to that illustrated in FIG. 9 except that an upper plate 40*a*, a lower plate 40*b*, and a side plate 40*c* are substituted for the single conductive wire used in FIG. 9 and that first through fourth ends 41 to 44 are disposed like in FIG. 5. As shown in FIG. 10, each of the upper and the lower plates 40*a* and 40*b* is opposed to the other with a gap left therebetween and is of a rectangular shape having a pair of short sides and a pair of long sides contiguous to the short sides. One of the short sides of each of the upper and the lower plates 40*a* and 40*b* is contiguous to the side plate 40*c* while the other short side of the upper plate 40*a* is spaced apart from the other short side of the lower plate 40*b*. The long sides of each of the upper and the lower plates 40*a* and 40*b* are contiguous to the short sides of each plate 40*a* and 40*b* and are substantially orthogonal to the short sides of each plate 40*a* and 40*b*.

The first antenna element 31 is formed between the other short sides of the upper and the lower plates 40*a* and 40*b* while the second antenna element 32 is formed between the long sides of the upper and the lower plates 40*a* and 40*b*. More specifically, the first and the second rods 41 and 42 are extended from the upper and the lower plates 40*a* and 40*b* towards the bottom and the top of FIG. 10, resepctively, like in FIG. 5. The first and the second rods 41 and 42 define the first pair of end portions A and B and are somewhat displaced from each other to be connected to the variable capacitor 22 in the manner described in conjunction with FIG. 5. Each of the first and the second rods 41 and 42 is adjacent to the front vertex between the short and the long sides which is placed away from the side plate 40*c*.

The third rod 43 is directed towards the bottom of FIG. 10 in the vicinity of a rear vertex between the short and the long sides of the upper plate 40*a*. The third rod 43 is shorter than a half of the gap, as is the case with the third rod illustrated in FIG. 5. The fourth rod 44 is extended from the lower plate 40*b* towards the top, opposing the third rod 43, and is not brought into contact with the third rod 43 in FIG. 10. Thus, the third and the fourth rods 43 and 44 serve to determine the first and the second intermediate portions C and D on the upper and the lower plates 40*a* and 40*b*, respectively.

The first through the fourth rods 41 to 44 serve to define the first antenna element along the other short sides of the upper and the lower plates 40*a* and 40*b*. The first antenna element has the first predetermined aperture area specified by the first through the fourth rods 41 to 44.

The second antenna element is substantially defined along the long sides of the upper and the lower plates 40*a* and 40*b* by the first and the second rods 41 and 42 and third and fourth intermediate portions E and F similar to those illustrated in FIG. 5. The first pair of end portions A and B and the third and the fourth intermediate portions E and F are coplanar to form the second predetermined aperture area substantially orthogonal to the first predetermined aperture area.

Figure 11:
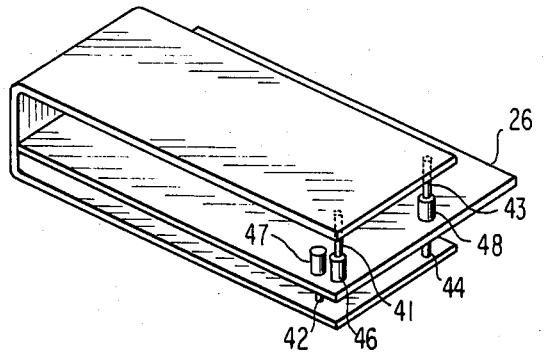
FIG. 11 shows a perspective view of the antenna illustrated in FIG. 10 and assembled on a printed board.

Referring to FIG. 11, the antenna illustrated in FIG. 10 is assembled on a printed board 26 in a manner described in conjunction with FIGS. 6 and 7. More particularly, the first and the second rods 41 and 42 are connected through first and second receptacles 46 and 47 across the variable capacitor deposited on the printed board 26 while the third and the fourth rods 43 and 44 are connected to each other throught the third receptacle 48.

Thus, the first and the second antenna elements 31 and 32 form the first and the second antenna circuits, respectively, when the reactance circuit, such as the variable and the additional capacitors 22 and 24 are connected to the first and the second antenna elements 31 and 32. The first and the second antenna circuits have the first and the second loops formed between the first antenna element 31 and the variable capacitor 22 and between the second antenna element 32 and the variable capacitor 22, respectively. The first antenna element 31 has the first inductance $L_1$ while the second antenna element 32 has the second inductance $L_2$ which is greater than the first inductance $L_1$, like in FIG. 5. With this structure, the antenna reactance is substantially determined by the first inductance $L_1$ and the antenna aperture area is determined by the second predetermined aperture area. As a result, the antenna inductance and the antenna gain are rendered small and high, respectively, in comparison with the conventional antenna.

The antenna described with reference to FIGS. 10 and 11 has a wide frequency band similar to that illustrated in FIG. 8 and directivity improved by 8 dB as compared with the antenna illustrated in FIGS. 5 through 7. The additional capacitor 24 may not be changed over the wide frquency band because the antenna per se is resonant to the wide frequency band.

While this invention has thus far been described in conjunction with several embodiments thereof, it will readily be possible for those skilled in the art to put this invention into practice in various other manners. For example, more than two loops may be formed in the manner described with reference to FIG. 4. In FIGS. 5 and 10, thin sheets or plates may be used for connection between the upper and the lower plates 40*a* and 40*b* instead of the rods 41 to 44. The first and the second antenna elements may be capacitive when the reactance circuit is inductive.

What is claimed is:

1. An antenna for use in connection with a reactance circuit in a miniature radio receiver, comprising:

a first antenna element having a first pair of ends, a first conductive path which is connected to said first pair of ends and which has a first predetermined reactance, and a first predetermined aperture area determined by a first loop formed by said first conductive path and said reactance circuit when said reactance circuit is connected to said first pair of ends;

a second antenna element having a second pair of ends connected in common to said first pair of ends, a second conductive path which is connected to said second pair of ends and which has a second predetermined reactance greater than said first predetermined reactance, and a second predetermined aperture area which is determined by a second loop formed by said second conductive path and said reactance circuit when said reactance circuit is connected to said second pair of ends and which is greater than said first predetermined aperture area; and said antenna having an antenna aperture area substantially specified by said second predetermined aperture area and a antenna reactance given by a combination of said first and said second predetermined reactances, whereby said antenna is adapted to receive high frequency signals with high gain.

2. An antenna as claimed in claim 1, wherein said reactance circuit is capacitive while each of said first and said second predetermined reactances and said antenna reactance is inductive.

3. An antenna as claimed in claim 2, wherein said first and said second predetermined areas are coplanar.

4. An antenna as claimed in claim 1, wherein said second predetermined aperture area is substantially orthogonal to said first predetermined aperture area.

5. An antenna as claimed in claim 2, wherein said second loop is partially superposed on said first loop.

* * * * *